US010673172B2

(12) United States Patent
Zhang et al.

(10) Patent No.: US 10,673,172 B2
(45) Date of Patent: Jun. 2, 2020

(54) USB CONNECTOR

(71) Applicant: SHENZHEN EVERWIN PRECISION TECHNOLOGY CO LTD, Guangdong (CN)

(72) Inventors: Shaocan Zhang, Guangdong (CN); Xiaoshuo Chen, Guangdong (CN); Su Lu, Guangdong (CN)

(73) Assignee: SHENZHEN EVERWIN PRECISION TECHNOLOGY CO LTD, Guangdong (CN)

( * ) Notice: Subject to any disclaimer, the term of this patent is extended or adjusted under 35 U.S.C. 154(b) by 0 days.

(21) Appl. No.: 16/408,665

(22) Filed: May 10, 2019

(65) Prior Publication Data

US 2019/0267744 A1 Aug. 29, 2019

Related U.S. Application Data

(63) Continuation of application No. PCT/CN2018/088205, filed on May 24, 2018.

(30) Foreign Application Priority Data

Sep. 21, 2017 (CN) ..... 2017 1 0858729
Sep. 21, 2017 (CN) ..... 2017 1 0862543

(51) Int. Cl.
*H01R 13/504* (2006.01)
*H01R 13/447* (2006.01)
(Continued)

(52) U.S. Cl.
CPC ..... *H01R 13/504* (2013.01); *H01R 12/707* (2013.01); *H01R 12/716* (2013.01);
(Continued)

(58) Field of Classification Search
CPC ..... H01R 13/504; H01R 13/447; H01R 13/6594; H01R 13/52
(Continued)

(56) References Cited

U.S. PATENT DOCUMENTS 9,209,573 B1 * 12/2015 Chen ..... H01R 13/6581
9,429,360 B2 * 8/2016 Hsiao ..... F26B 3/28
(Continued)

FOREIGN PATENT DOCUMENTS

CN 202840058 U 3/2013
CN 203119185 U * 8/2013
(Continued)

OTHER PUBLICATIONS

International Search Report for International application No. PCT/CN2018/088205 dated Aug. 29, 2018.

*Primary Examiner* — Abdullah A Riyami
*Assistant Examiner* — Nader J Alhawamdeh
(74) *Attorney, Agent, or Firm* — Carlson, Gaskey & Olds

(57) ABSTRACT

A USB connector includes a docking assembly, a first metal member sleeved on the docking assembly, a plastic housing, and a second metal member integrated with and formed inside the plastic housing. The docking assembly includes an insulation body including a base and a docking tongue extending forward from the base and a conductive terminal integrated with and formed inside the insulation body. The first metal member includes an annular body sleeved on the base and welding feet extending rearward from two opposite sides of the annular body. The second metal member includes a plate body formed on a side wall of the plastic housing. Second welding portions formed by two sides of the plate body are bent and then extend toward the circuit board and a holding piece extending rearward from the plate body and fastened at a tail of the base of the insulation body.

20 Claims, 7 Drawing Sheets

(51) Int. Cl.

| | |
|---|---|
| ***H01R 13/6594*** | (2011.01) |
| ***H01R 12/71*** | (2011.01) |
| ***H01R 12/70*** | (2011.01) |
| *H01R 13/52* | (2006.01) |
| *H01R 12/58* | (2011.01) |
| *H01R 13/6593* | (2011.01) |

(52) U.S. Cl.
CPC ..... *H01R 13/447* (2013.01); *H01R 13/6594* (2013.01); *H01R 12/58* (2013.01); *H01R 13/52* (2013.01); *H01R 13/521* (2013.01); *H01R 13/5216* (2013.01); *H01R 13/6593* (2013.01)

(58) Field of Classification Search
USPC ..... 439/131
See application file for complete search history.

(56) References Cited

U.S. PATENT DOCUMENTS

2012/0315779 A1* 12/2012 Yudate ..... H01R 12/724 439/271
2013/0040493 A1* 2/2013 Wu ..... H01R 13/506 439/607.55
2013/0065442 A1* 3/2013 Nagata ..... H01R 13/5202 439/607.58
2013/0183844 A1* 7/2013 Wang ..... H01R 24/68 439/271
2014/0342599 A1* 11/2014 Zhang ..... H01R 12/724 439/521
2016/0164218 A1* 6/2016 Lee ..... H01R 13/5202 439/587
2016/0197443 A1* 7/2016 Zhang ..... H01R 13/6585 439/607.05
2017/0338576 A1* 11/2017 Sato ..... H01R 4/184
2017/0338584 A1* 11/2017 Yao ..... H01R 4/28
2018/0166830 A1* 6/2018 Feng ..... H01R 13/6593

FOREIGN PATENT DOCUMENTS

CN 203119185 U 8/2013
CN 104183965 A 12/2014
CN 107069309 A 8/2017
CN 107069338 A * 8/2017
CN 107069338 A 8/2017
CN 107799962 A 3/2018

* cited by examiner

USB CONNECTOR

CROSS-REFERENCE TO RELATED APPLICATIONS

This application is a continuation of International Application No. PCT/CN2018/088205, filed on May 24, 2018, which claims priority to Chinese Patent Application No. 201710858729.6, filed on Sep. 21, 2017, and Chinese Patent Application No. 201710862543.8, filed on Sep. 21, 2017, the contents of which are incorporated herein by reference in their entireties.

TECHNICAL FIELD

The present disclosure relates to the technical field of electrical connectors, and particularly, to a USB connector.

BACKGROUND

In the field of conventional mobile phones, most antennas of the mobile phones are externally mounted, i.e., the antennas extend to the outside of the mobile phone. Such an arrangement has a defect of imperfect appearance, and at the same time, occupies too much space. Then, built-in antennas are adopted in the field of mobile phones, that is, the antennas are placed inside an outer cover of the mobile phone, thereby solving the problem of appearance.

Currently, due to the use of a metal middle frame in the mobile phone, most terminal manufacturers directly set a middle frame of a mobile phone as an antenna of the mobile phone. However, an iron housing of a USB connector that passes through the metal middle frame would severely interfere with a radio-frequency signal of the antenna of the mobile phone.

SUMMARY

In view of above, it is necessary to provide a USB connector, aiming to avoid interfering with antenna signal while considering a structural strength without a metal housing.

In order to solve the above technical problem, the present disclosure provides a USB connector to be welded on a circuit board. The USB connector includes a docking assembly, a first metal member sleeved on the docking assembly, a plastic housing provided with a receiving cavity, and a second metal member integrated with and formed inside the plastic housing. The docking assembly and the first metal member are inserted into the plastic housing; the docking assembly includes an insulation body and a conductive terminal integrated with and formed inside the insulation body. The insulation body includes a base and a docking tongue extending forward from the base. The first metal member includes an annular body sleeved on the base and welding feet extending rearward from two opposite sides of the annular body. The second metal member includes a plate body formed on a side wall of the plastic housing, second welding portions formed by two sides of the plate body being bent and then extending towards the circuit board, and a holding piece extending rearward from the plate body and fastened at a tail of the base of the insulation body. The welding feet of the first metal member and the second welding portions of the second metal member are respectively configured to be welded to corresponding positions of the circuit board.

In an example embodiment, a waterproof glue is applied on a tail of the docking assembly and a tail of the plastic housing, and the waterproof glue is filled in a gap between the insulation body, the plastic housing, the first metal member, and the second metal member.

In an example embodiment, a protruding portion is formed by a rear end of the base extending rearward, the protruding portion is provided with a through-slot, and the conductive terminal is partially located in the through-slot.

In an example embodiment, the waterproof glue is filled in the through-slot and surrounds the conductive terminal.

In an example embodiment, the tail of the plastic housing is flush with the protruding portion, an annular glue-receiving groove is formed between the plastic housing and the protruding portion, and the waterproof glue, taking the protruding portion as a support point, is firmly adhered inside the glue-receiving groove and the through-slot.

In an example embodiment, a snap groove is provided at an end of the base of the insulation body close to the docking tongue, a snap-in portion fastened with the snap groove is provided at a front end of the annular body of the first metal member, and a snap-in portion fixed to a rear end of the base is provided at a rear end of the annular body corresponding to the base.

In an example embodiment, shoulder portions are formed by two lateral sides of the base extending outward, receiving portions are provided at positions on two lateral sides of the first metal member corresponding to the shoulder portions, and the shoulder portions are fastened with the receiving portions.

In an example embodiment, the first metal member further includes an extending portion attached to an inner side wall of the receiving cavity, a recess or a hole structure is provided on the extending portion, an inner surface of the extending portion is not higher than an inner surface of the corresponding inner side wall of the receiving cavity, and the extending portion and the plate body of the second metal member are located on two opposite side walls of the receiving cavity, respectively.

In an example embodiment, the recess or the hole structure is provided on the plate body of the second metal member.

In an example embodiment, the recesses or hole structures are completely covered by the plastic housing.

In order to solve the above technical problem, the present disclosure further provides a USB connector, including a docking assembly, a first metal member sleeved on the docking assembly, a plastic housing provided with a receiving cavity, and a second metal member integrated with and formed inside the plastic housing. The docking assembly and the first metal member are inserted into the plastic housing. The docking assembly includes an insulation body and a conductive terminal integrated with and formed inside the insulation body. The insulation body includes a base and a docking tongue extending forward from the base. The first metal member includes an annular body sleeved on the base and welding feet extending rearward from two opposite sides of the annular body. The second metal member includes a plate body formed on a side wall of the plastic housing and first welding portions formed by two sides of the plate body extending rearward. The first welding portions and the welding feet are attached to one another and welded into one piece.

In an example embodiment, a waterproof glue is applied on a tail of the docking assembly and a tail of the plastic housing, and the waterproof glue is filled in a gap between the insulation body, the plastic housing, the first metal member, and the second metal member.

In an example embodiment, a protruding portion is formed by a rear end of the base of the insulation body extending rearward, the protruding portion is provided with a through-slot, and the conductive terminal is partially located in the through-slot.

In an example embodiment, the waterproof glue is filled in the through-slot and surrounds the conductive terminal.

In an example embodiment, the tail of the plastic housing is flush with the protruding portion, an annular glue-receiving groove is formed between the plastic housing and the protruding portion, and the waterproof glue, taking the protruding portion as a support point, is firmly adhered inside the glue-receiving groove and the through-slot.

In an example embodiment, a snap groove is provided at an end of the base of the insulation body close to the docking tongue, a snap-in portion fastened with the snap groove is provided at a front end of the annular body of the first metal member, and a snap-in portion fixed to a rear end of the base is provided at a rear end of the annular body corresponding to the base.

In an example embodiment, shoulder portions are formed by two lateral sides of the base extending outward, receiving portions are provided at positions on two lateral sides of the first metal member corresponding to the shoulder portions, and the shoulder portions are fastened with the receiving portions.

In an example embodiment, a recessed portion is provided between the two shoulder portions of the base, and the recessed portion accommodates a part of the annular body that extends rearward in such a manner that a surface of the annular body is not higher than a surface of the base.

In an example embodiment, a recess is provided on the plate body of the second metal member, and an outer surface of a convex portion of the recess is covered by the plastic housing without being exposed to the outside.

In an example embodiment, the second metal member further includes second welding portions formed by two lateral sides being bent and then extending, and the welding feet of the first metal member and the second welding portions are configured to be welded to a circuit board.

The USB connector according to the present disclosure adopts a plastic housing, in order to avoid a direct contact with the metal housing of the mobile phone, which would otherwise affect a radio frequency signal of the mobile phone. At the same time, the structural strength of the USB connector is guaranteed by providing a first metal member fixed with the docking assembly and a second metal member integrated with the plastic housing, as well as welding the first metal member and the second metal member to the circuit board.

BRIEF DESCRIPTION OF DRAWINGS

The accompanying drawings described herein are intended to provide a further understanding of the present disclosure, and belong to a part of the present disclosure. The illustrative embodiments of the present disclosure and description thereof aim to explain the present disclosure, instead of constituting an undue limitation of the present disclosure.

FIG. 1 is a perspective view of a USB connector integrally welded on a printed circuit board according to the present disclosure;

FIG. 2 is an perspective exploded view of the USB connector according to the present disclosure;

FIG. 3 is an perspective exploded view of a docking assembly and a first metal member of the USB connector according to the present disclosure;

FIG. 4 is another perspective exploded view of the docking assembly and the first metal member of the USB connector according to the present disclosure;

FIG. 5 is a perspective assembled view of the docking assembly and the first metal member of the USB connector according to the present disclosure;

FIG. 6 is a cross-sectional view of the USB connector according to the present disclosure;

DESCRIPTION OF EMBODIMENTS

In order to clarify the purposes, technical solutions, and advantages of the present disclosure, the technical solutions of the present disclosure will be clearly and fully described with reference to specific embodiments and accompanying drawings of the present disclosure. It is apparent that the described embodiments are only a part of the embodiments of the present disclosure, rather than all of them. All other embodiments, which are obtained by those skilled in the art based on the disclosed embodiments of the present disclosure without departing from the inventive scope, shall fall within the scope of the present disclosure.

Embodiment 1

Figure 1:
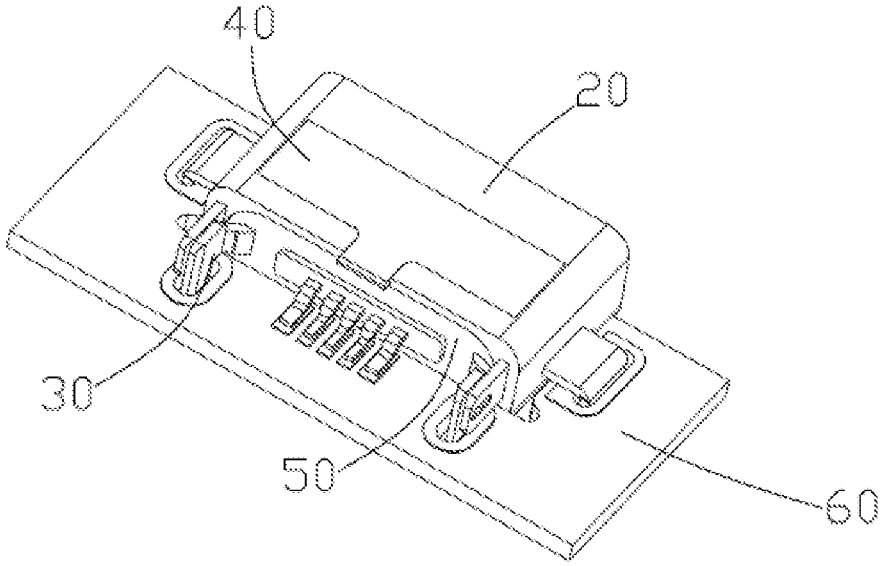
FIG. 1 to FIG. 5 are schematic diagrams of Embodiment 1 of the present disclosure.
Figure 2:
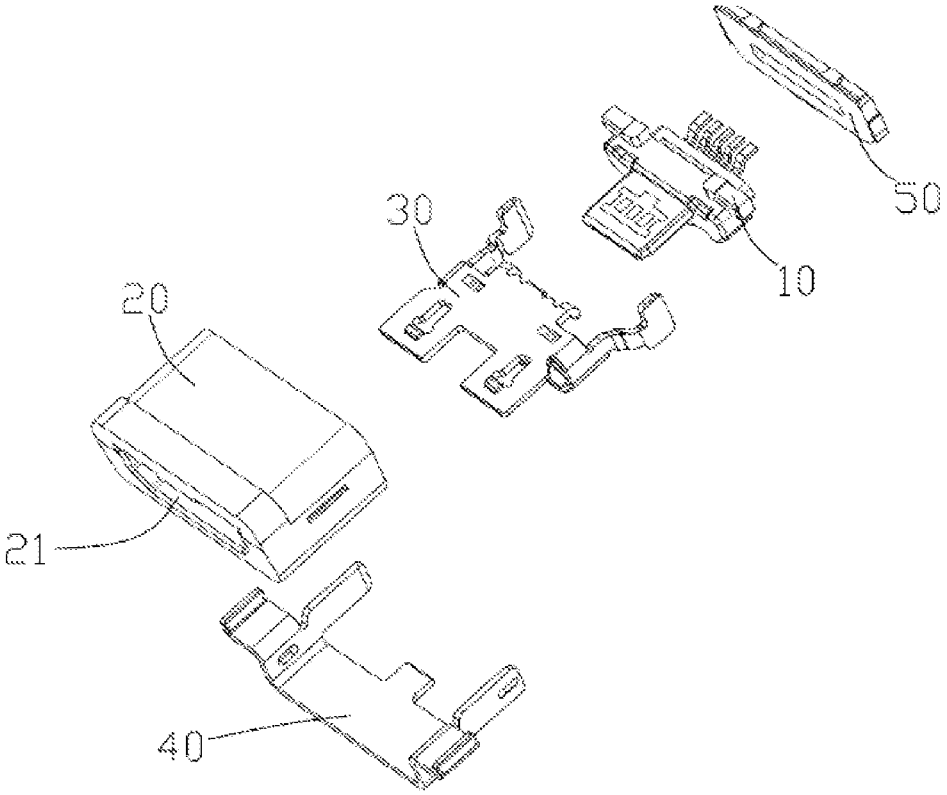

Referring to FIG. 1 and FIG. 2, a USB connector according to the present disclosure includes a docking assembly 10, a first metal member 30 sleeved on the docking assembly 10, a plastic housing 20 for inserting the first metal member 30 and the docking assembly 10, a second metal member 40 integrated with and formed inside the plastic housing 20, and a waterproof glue 50 applied on a tail of the docking assembly 10 and a tail of the plastic housing 20.

Figure 3:
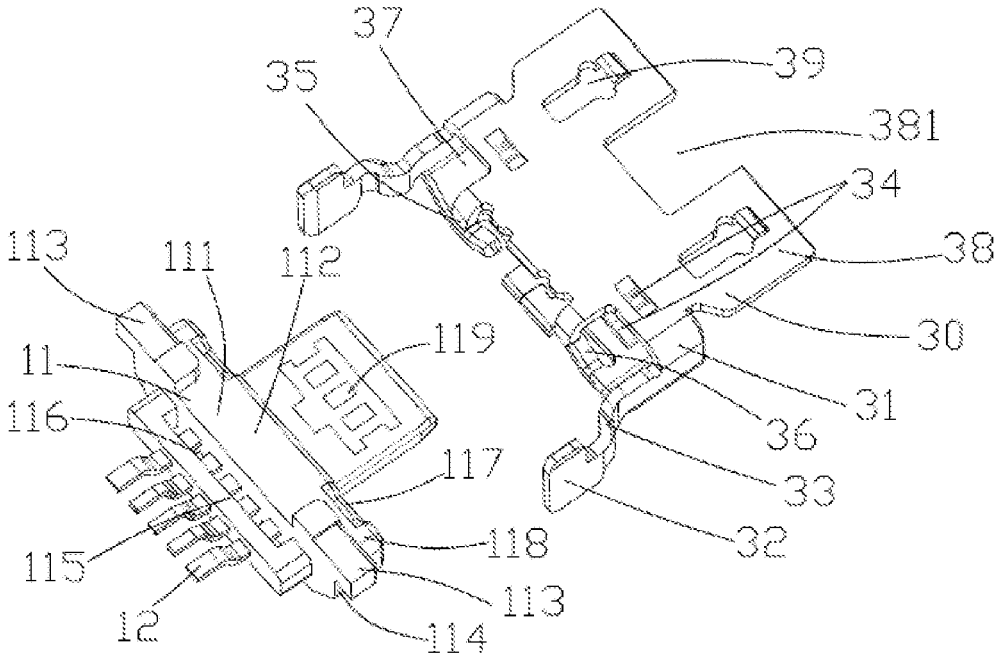
Figure 4:
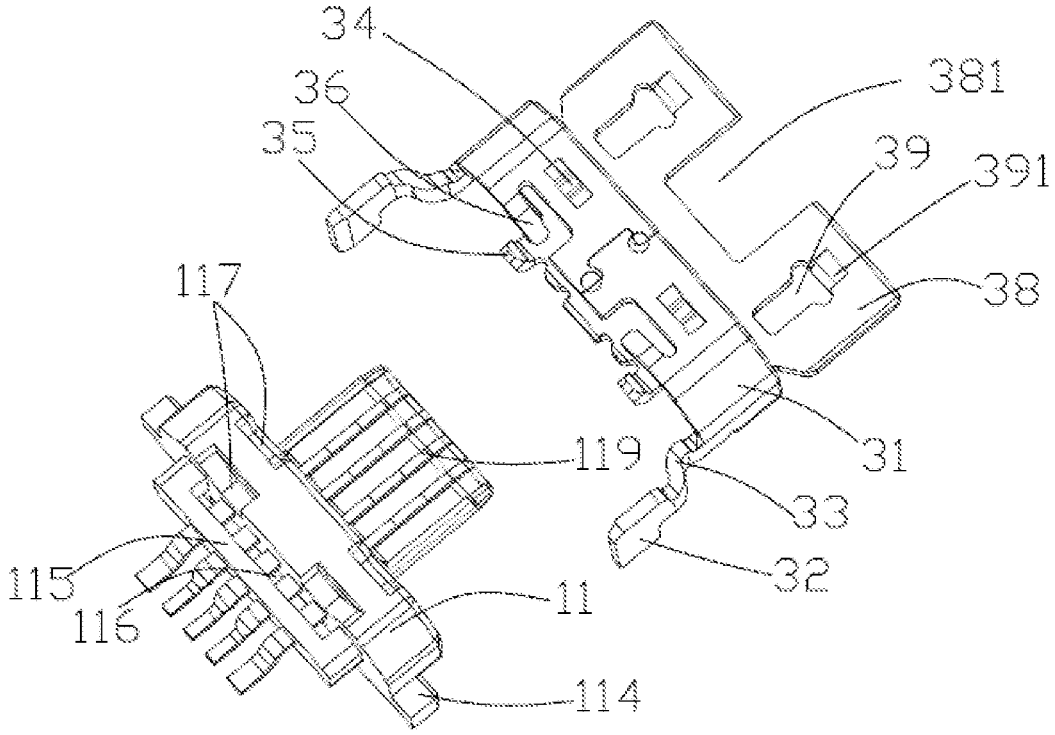
Figure 5:
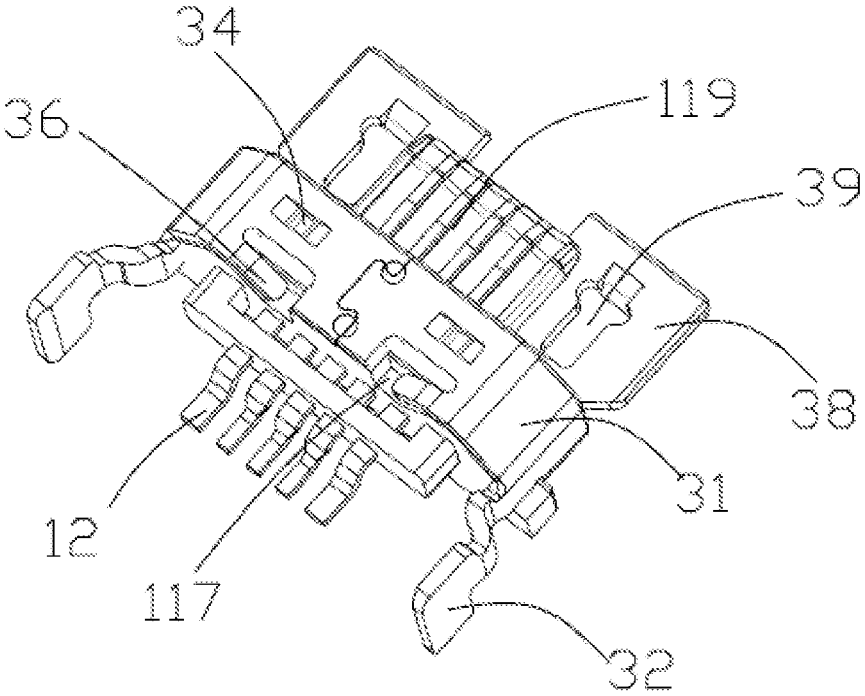

Referring to FIG. 3, FIG. 4 and FIG. 5, the docking assembly 10 includes an insulation body 11, and a conductive terminal 12 integrated with and formed inside the insulation body 11. The insulation body 11 includes a base 111 and a docking tongue 119 extending forward from the base 111. The base 111 includes a recessed portion 112 recessed downward from an upper surface of the base 111, shoulder portions 113 extending from two lateral sides of the base 111, hollow portions 114 formed under the shoulder portions 113, a protruding portion 115 extending from a rear end of the base 111, a through-slot 116 penetrating through the protruding portion 115 in a vertical direction, a mounting portion 118 formed at an end of the base 111 close to the docking tongue 119, and a plurality of snap grooves 117 recessed at the mounting portion 118 and the rear end of the base 111. Both upper and lower surfaces of the mounting portion 118 are provided with the snap groove 117, and at least one surface of the rear end of the base 111 facing away from the docking tongue 119 is provided with the snap groove 117.

The conductive terminal 12 extends through the base 111 to the docking tongue 119 and protrudes from the docking tongue 119. The conductive terminal 12 is partially located in the through-slot 116 and is visible to the naked eye.

The first metal member 30 includes an annular body 31, welding feet 32 extending rearward from two lateral sides of the annular body 31, an extending portion 38 extending from a side of the annular body 31 facing the docking tongue 119, recesses or hole structures 39 provided on two lateral sides of the extending portion 38, a plurality of snap-in portions 34, 35 and 36 formed on the annular body 31 and fastened with the plurality of snap grooves 117, and a receiving portion 37 formed by cutting at positions on the two lateral sides of the annular body 31 corresponding to the shoulder portions 113 of the insulation body 11. The welding foot 32 extends laterally outward from the annular body 31 and then extends rearward, thereby forming a bending portion 33. The snap-in portions 35 and 36 at the rear end of the first metal member 30 are formed by stamping, bending, or the like after the first metal member 30 is mounted on the base 111 of the docking assembly 10, and the snap-in portions 35 and 36 are fastened with the snap grooves 117 at the rear end of the insulation body 11 or bent to be fixed on a surface of the tail of the base 111. In this way, the first metal member 30 is irreversibly fixed to the docking assembly 10. The extending portion 38 of the first metal member 30 is cut in the middle to form a breach 381 for increasing a bonding force with the plastic housing 20. At a front side of the hole structure 39, an inclined guiding portion 391 is formed to facilitate smooth engaging and retracting of a hook (not shown) of a docking plug.

Figure 6:
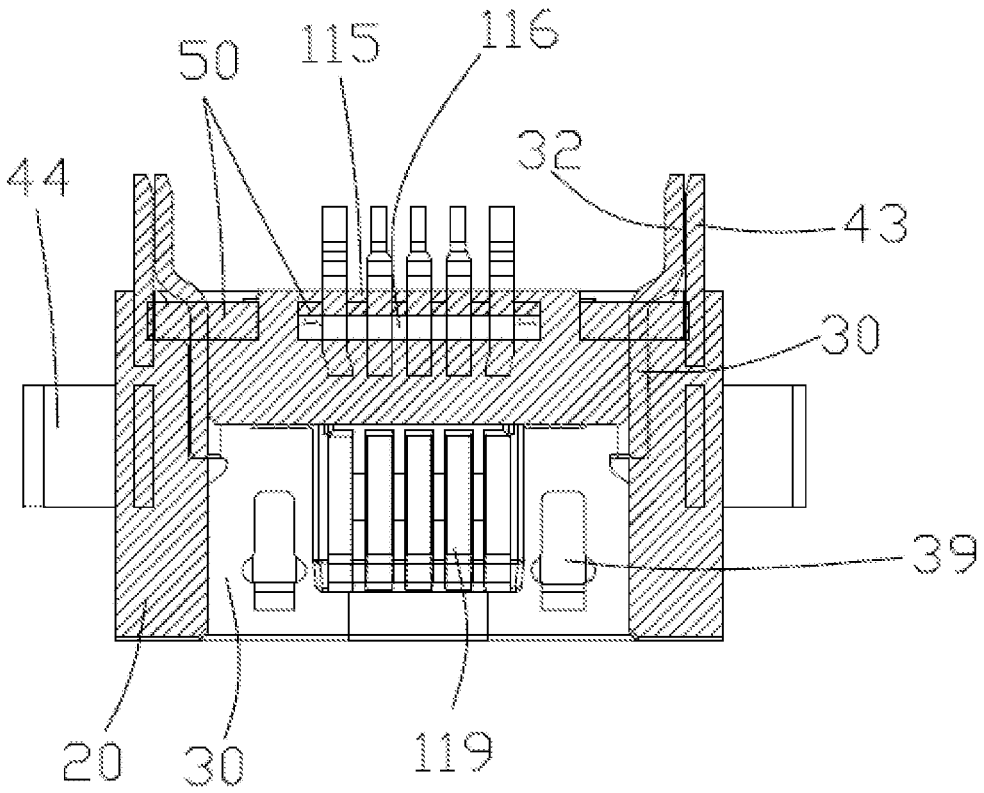
FIG. 6 is a schematic diagram of Embodiment 2 of the present disclosure.

Referring to FIG. 2, FIG. 5 and FIG. 6, the plastic housing 20 has a hollow structure, and includes a receiving cavity 21 for receiving the docking assembly 10. The first metal member 30 is attached to an upper inner wall of the receiving cavity 21 of the plastic housing 20, and a groove structure (not shown) for accommodating the extending portion 38 is provided in the upper inner wall of the receiving cavity 21 such that the surface of the extending portion 38 does not protrude from the upper inner wall of the receiving cavity 21. The second metal member 40 is integrated with and formed on a lower inner wall of the plastic housing 20 opposite to the upper inner wall, and includes a plate body 41, first welding portions 43 formed by two lateral sides of the plate body 41 being bent and then extending rearward, and second welding portions 44 formed by the two lateral sides of the plate body 41 being bent firstly, then being bent and extending in a lateral direction and then being bent again. The first welding portions 43 and the welding feet 32 of the first metal member 30 are in contact for fixing of spot welding. The recess or hole structure 39 of the first metal member 30 is completely covered by the upper wall of the plastic housing 20 without being exposed to the outside.

In an embodiment, the recess or hole structure 39 also can be provided on the plate body 41. In such situation, it is merely needed to exchange positions of the plate body 41 and the extending portion 38 on the upper and lower walls of the plastic housing 20. That is, the extending portion 38 extends to be attached on the lower inner wall of the plastic housing, and the plate body 41 is integrated with and formed on the upper inner wall of the plastic housing 20.

The protruding portion 115 at the tail of the insulation body 11 is flush with the surface of the tail of the plastic housing 20, so that an annular glue-receiving groove (not labeled) is formed between the plastic housing 20 and the protruding portion 115.

The glue 50 is applied in the glue-receiving groove at a junction of the tails of the docking assembly 10 and the plastic housing 20. At the same time, the glue passes through the through-slot 116 in the protruding portion 115 of the insulation body 11 to produce more adhesive points for the glue, such that the glue is more firmly adhered to the tails of the docking assembly 10 and the plastic housing 20 and spreads to the gap between the insulation body 11 and the plastic housing 20. Meanwhile, due to the presence of the through-slot 116, the glue surrounds the conductive terminal 12 to prevent water from seeping between the conductive terminal 12 and the insulation body 11.

The welding foot 32 and the second welding portion 44 are inserted into a welding hole of the circuit board 60 to be fixed by welding.

Referring to FIG. 1 to FIG. 6, the assembly principle of the USB connector according to the present disclosure will be described in detail below with reference to the accompanying drawings.

Firstly, a docking assembly 10 is provided. The docking assembly 10 is manufactured in two injection molding processes of the conductive terminal 12. In the first injection molding, the base 111 of the insulation body 11 and a part of the docking tongue 119 are formed, in which the conductive terminal 12 must be fixed during the injection molding at the docking tongue 119 and thus a gap exits at the conductive terminal 12 of the docking tongue 119. The gap is filled in the second injection molding.

Subsequently, the first metal member 30 formed by stamping is sleeved on the base 111 of the insulation body 11 from the docking tongue 119 of the docking assembly 10. At this time, the annular body 31 of the first metal member 30 just fits the mounting portion 118 at a front end of the base 111, and a part of the annular body 31 extends rearward into the recessed portion 112 such that the outer surface of the annular body 31 is not higher than the upper surface of the base 111. After the sleeving is finished, the snap-in portion 34 at the front end of the first metal member 30 is fastened in the snap groove 117 at the front end of the base 111, and then the snap-in portions 35 and 36 at the rear end of the first metal member 30 are bent or stamped, and fastened with the snap groove 117 at the front end of the base 111 or on the surface of the tail of the base 111, such that the first metal member 30 is irreversibly fixed on the insulation body 11.

Then, the second metal member 40 and the plastic housing 20, formed into one piece, are provided. The docking assembly 10 and the first metal member 30 are inserted into the plastic housing 20 from one end of the plastic housing 20. At this time, the welding feet 32 of the first metal member 30 are in contact with the first welding portions 43 of the second metal member 40, and the welding feet 32 and the first welding portion 43 are welded by spot welding, such that the plastic housing 20 and the docking assembly 10 are fixed into one piece. The extending portion 38 of the first metal member 30 extends forward into the groove structure of the plastic housing 20, and is fixed in the groove structure in a built-in manner or an edge snapping manner.

Finally, the waterproof glue 50 is applied on the tails of the docking assembly 10 and the plastic housing 20, and infiltrates into the gaps between the plastic housing 20, the insulation body 11, the first metal member 30 and the second metal member 40, such that the tail of USB connector and the receiving cavity 21 of the plastic housing 20 are hermetically waterproof, thereby preventing water in the receiving cavity 21 from entering an electronic device through the gap filled with the waterproof glue 50. In the meantime, the waterproof glue 50 is filled in the through-slot 116 at the tail of the insulation body 11, surrounding the conductive terminal 12, so as to increase airtightness between the conductive terminal 12 and the insulation body 11. In addition, the protruding portion 115 is at a middle position, so as to form a good support point for the waterproof glue 50 and avoid detachment of the waterproof glue 50 after being dried, thereby enhancing the waterproof effect.

The USB connector is finally mounted on the circuit board 60, and the welding feet 32 of the first metal member 30 and the second welding portions 44 of the second metal member 40 are welded to the circuit board 60 in a patch-attaching manner or a hole-inserting manner. A multi-spot welding enhances the robustness and stability of the USB connector, and ensures that an external force will not change relative positions of the plastic housing 20 and the docking assembly 10 on the circuit board 60, thereby improving the performance and waterproof performance.

The USB connector according to the present disclosure adopts the plastic housing 20, in order to avoid a direct contact with the metal housing of the mobile phone, which would otherwise affect a radio frequency signal of the mobile phone. At the same time, a structural strength of the USB connector is guaranteed by providing a first metal member 30 fixed with the docking assembly 10 and a second metal member 40 integrated with the plastic housing 20, as well as welding the first metal member 30 and the second metal member 40, as a whole or separately, to the circuit board 60.

In the meantime, in the USB connector according to the present disclosure, the waterproof glue 50 is applied on the tails of the docking assembly 10 and the plastic housing 20, and filled in the gaps between the insulation body 11, the plastic housing, the first metal member 30 and second metal member 40, so as to achieve the waterproofness.

Embodiment 2

Figure 7:
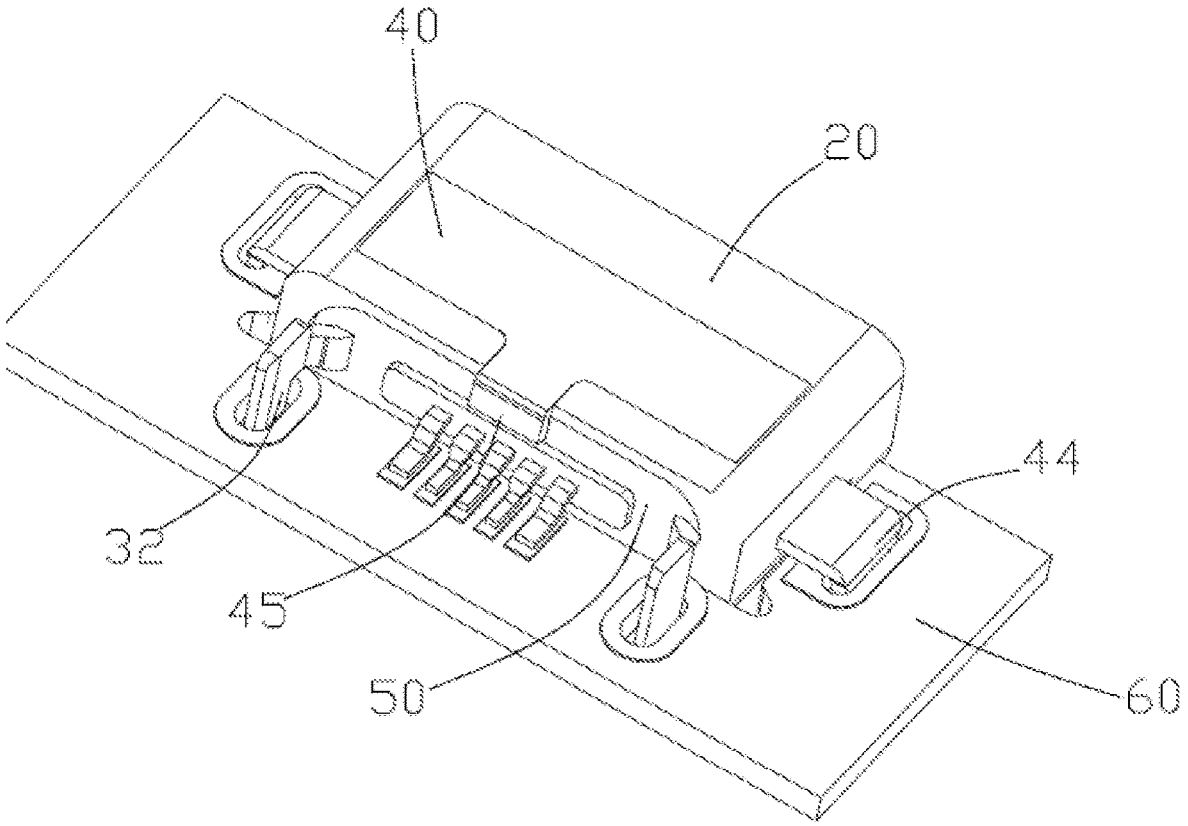
FIG. 7 is a perspective view of a USB connector integrally welded on a printed circuit board according to the present disclosure.

Further referring to FIG. 7, Embodiment 2 according to the present disclosure differs from Embodiment 1 in that the second metal member 40 further includes at least one holding piece 45 extending rearward from the tail of the plate body 41. After the docking assembly 10 and the first metal member 30 are inserted into the plastic housing 20, the holding piece 45 is bent to fix a bending portion of the holding piece 45 on the surface of the tail of the base 111 of the insulation body 11, thereby integrating the plastic housing 20 and the docking assembly 10 as one piece. At this time, the first welding portions 43 of the second metal member 40 can be omitted, and the welding feet 32 of the first metal member 30 and the second welding portions 44 of the second metal member 40 are directly welded to the circuit board 60 to immobilize relative positions thereof. It is also possible to achieve stability and reliability between components.

Embodiment 3

Figure 8:
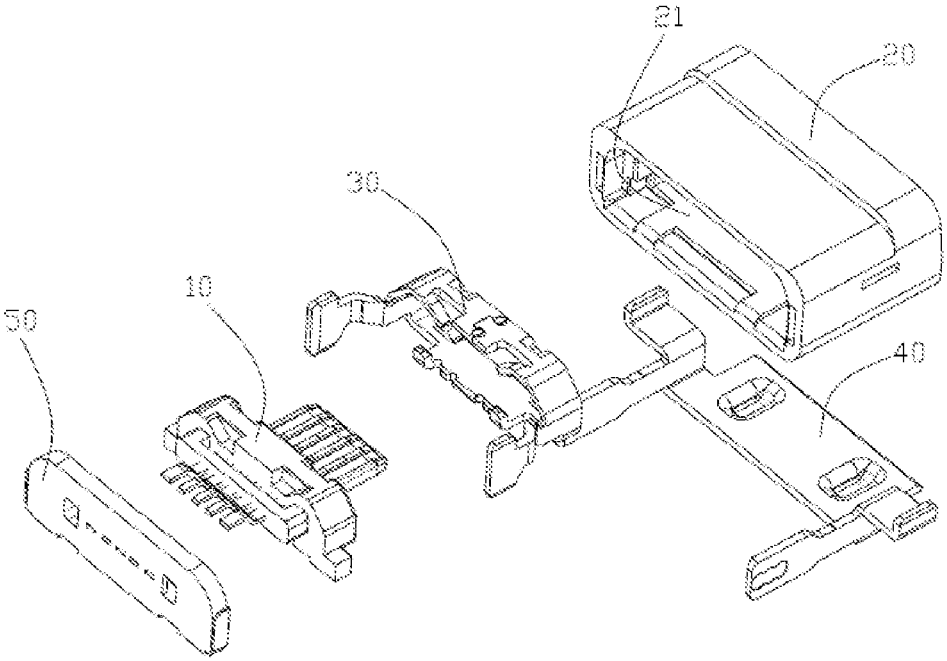
FIG. 8 is a perspective exploded view of a USB connector according to the present disclosure.
Figure 9:
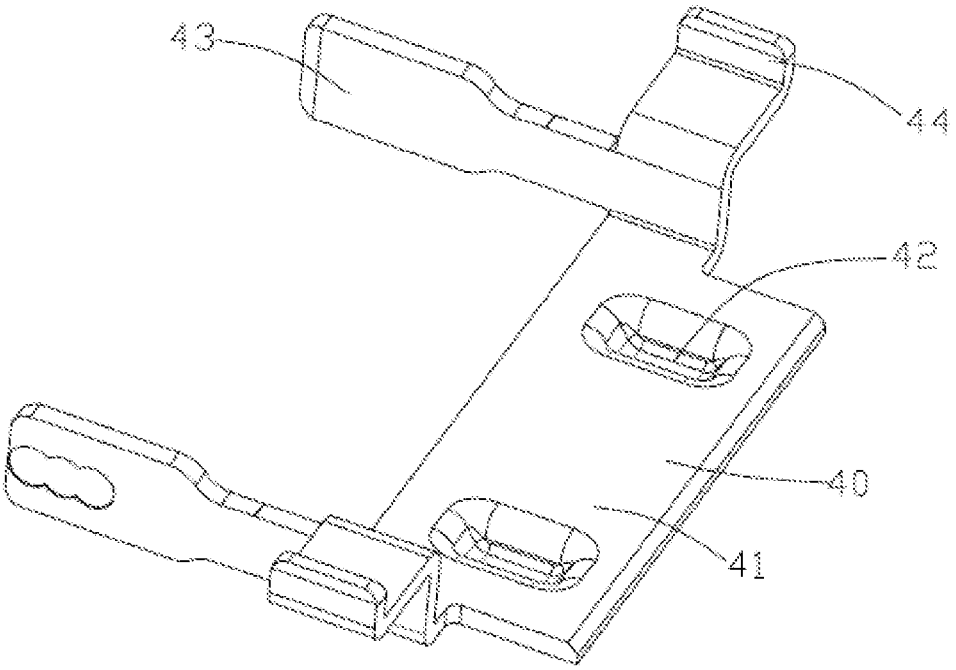
FIG. 9 is a perspective view of a second metal member of the USB connector shown in FIG. 8.
Figure 10:
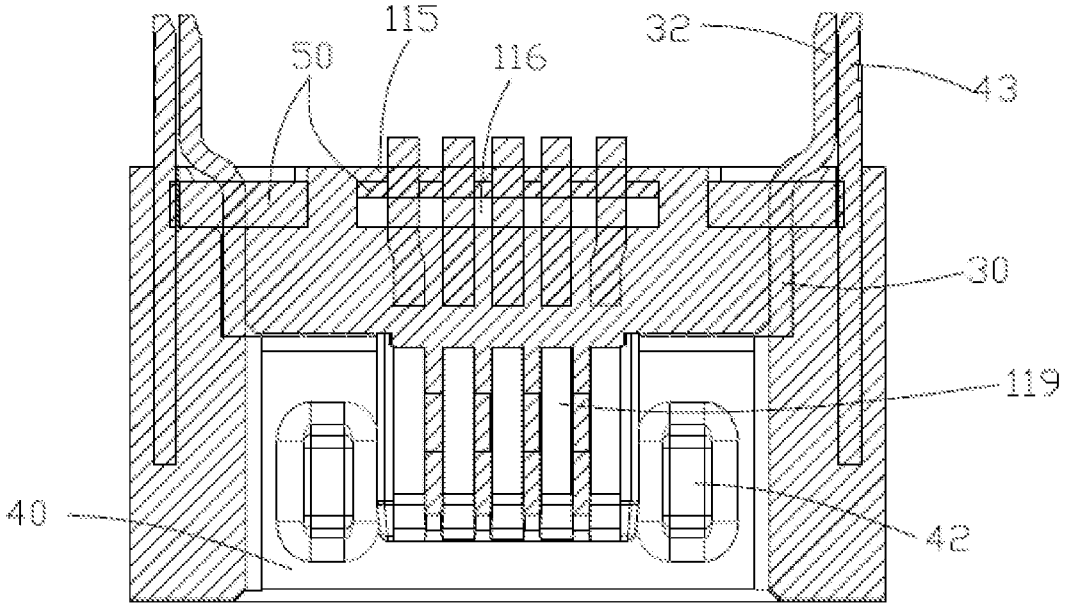
FIG. 10 is a cross-sectional view of the USB connector shown in FIG. 8.

Further referring to FIG. 8, FIG. 9, and FIG. 10, Embodiment 3 according to the present disclosure differs from Embodiment 1 in that, instead of providing the first metal member 30 with the extending portion 38 and the hole structure arranged on the extending portion 38, two recesses 42 for docking a buckle of a plug are formed on the plate body 41 of the second metal member 4. Specifically, the second metal member 40 is integrated with and formed in the lower wall of the plastic housing 20, and includes a plate body 41 and two recesses 42 formed on the plate body 41 for docking a buckle of a plug (not shown). The outer surfaces of the recesses 42 are completely covered by the plastic housing 20, i.e., a convex side of the recess 42 is not exposed to the outside.

In an embodiment, the annular body 31 of the first metal member 30 extends towards an insert-opening of the plastic housing 20 to form an extending portion, and the recesses 42 are disposed on the extending portion. In this case, the plate body 41 of the second metal member 40 is integrated with and formed on the other side of the plastic housing 20 opposite to the extending portion.

It should be understood that the terms "comprise", "include" or any other variants are intended to encompass a non-exclusive inclusion, such that a process, a method, a product, or an apparatus also includes described as including a series of element also includes other elements that are not explicitly listed, or elements that are inherent to such a process, method, product, or apparatus. Without any further limitations, the process, method, product, or apparatus defined by the expression "comprising an element" or "including an element" does not exclude the presence of other equivalent elements.

The above description refers to example embodiments of the present disclosure, rather than limit the scope of the present disclosure. Those skilled in the art understand that the technical solutions of the above embodiments can be modified. Any modification, equivalent substitution, or improvement made without departing from the spirit and principle of the present disclosure shall fall within the scope of protection defined by the claims.

What is claimed is:

1. A USB connector to be welded on a circuit board, the USB connector comprising:

a docking assembly;

a first metal member sleeved on the docking assembly;

a plastic housing provided with a receiving cavity; and a second metal member integrated with and formed inside the plastic housing, wherein the docking assembly and the first metal member are inserted into the plastic housing; the docking assembly comprises an insulation body and a conductive terminal integrated with and formed inside the insulation body; the insulation body comprises a base and a docking tongue extending forward from the base; the first metal member comprises an annular body sleeved on the base and welding feet extending rearward from two opposite sides of the annular body; the second metal member comprises a plate body formed on a side wall of the plastic housing, second welding portions formed by two sides of the plate body being bent and then extending towards the circuit board and a holding piece extending rearward from the plate body and fastened at a tail of the base of the insulation body; and the welding feet of the first metal member and the second welding portions of the second metal member are respectively configured to be welded to corresponding positions of the circuit board.

2. The USB connector according to claim 1, comprising a waterproof glue applied on a tail of the docking assembly and a tail of the plastic housing, and wherein the waterproof glue is filled in a gap between the insulation body, the plastic housing, the first metal member, and the second metal member.

3. The USB connector according to claim 2, wherein a protruding portion is formed by a rear end of the base extending rearward, the protruding portion is provided with a through-slot, and the conductive terminal is partially located in the through-slot.

4. The USB connector according to claim 3, wherein the waterproof glue is filled in the through-slot and surrounds the conductive terminal.

5. The USB connector according to claim 4, wherein the tail of the plastic housing is flush with the protruding portion;

an annular glue-receiving groove is formed between the plastic housing and the protruding portion; and the waterproof glue, taking the protruding portion as a support point, is firmly adhered inside the glue-receiving groove and the through-slot.

6. The USB connector according to claim 1, wherein a snap groove is provided at an end of the base of the insulation body close to the docking tongue;

a snap-in portion fastened with the snap groove is provided at a front end of the annular body of the first metal member; and a snap-in portion fixed to a rear end of the base is provided at a rear end of the annular body corresponding to the base.

7. The USB connector according to claim 6, wherein shoulder portions are formed by two lateral sides of the base extending outward;

receiving portions are provided at positions on two lateral sides of the first metal member corresponding to the shoulder portions; and the shoulder portions are fastened with the receiving portions.

8. The USB connector according to claim 1, wherein the first metal member comprises an extending portion attached to an inner side wall of the receiving cavity;

a recess or a hole structure is provided on the extending portion;

an inner surface of the extending portion is not higher than an inner surface of the corresponding inner side wall of the receiving cavity; and the extending portion and the plate body of the second metal member are located on two opposite side walls of the receiving cavity, respectively.

9. The USB connector according to claim 1, wherein a recess or a hole structure is provided on the plate body of the second metal member.

10. The USB connector according to claim 9, wherein the recesses or hole structure is completely covered by the plastic housing.

11. A USB connector, comprising:

a docking assembly;

a first metal member sleeved on the docking assembly;

a plastic housing provided with a receiving cavity; and a second metal member integrated with and formed inside the plastic housing, wherein the docking assembly and the first metal member are inserted into the plastic housing; the docking assembly comprises an insulation body and a conductive terminal integrated with and formed inside the insulation body; the insulation body comprises a base and a docking tongue extending forward from the base; the first metal member comprises an annular body sleeved on the base and welding feet extending rearward from two opposite sides of the annular body; the second metal member comprises a plate body formed on a side wall of the plastic housing and first welding portions formed by two sides of the plate body extending rearward; and the first welding portions and the welding feet are attached to one another and welded into one piece.

12. The USB connector according to claim 11, wherein a waterproof glue is applied on a tail of the docking assembly and a tail of the plastic housing; and the waterproof glue is filled in a gap between the insulation body, the plastic housing, the first metal member, and the second metal member.

13. The USB connector according to claim 12, wherein a protruding portion is formed by a rear end of the base of the insulation body extending rearward, the protruding portion is provided with a through-slot, and the conductive terminal is partially located in the through-slot.

14. The USB connector according to claim 13, wherein the waterproof glue is filled in the through-slot and surrounds the conductive terminal.

15. The USB connector according to claim 14, wherein the tail of the plastic housing is flush with the protruding portion;

an annular glue-receiving groove is formed between the plastic housing and the protruding portion; and the waterproof glue, taking the protruding portion as a support point, is firmly adhered inside the glue-receiving groove and the through-slot.

16. The USB connector according to claim 11, wherein a snap groove is provided at an end of the base of the insulation body close to the docking tongue, a snap-in portion fastened with the snap groove is provided at a front end of the annular body of the first metal member, and a snap-in portion fixed to a rear end of the base is provided at a rear end of the annular body corresponding to the base.

17. The USB connector according to claim 16, wherein shoulder portions are formed by two lateral sides of the base extending outward;

receiving portions are provided at positions on two lateral sides of the first metal member corresponding to the shoulder portions;

the shoulder portions are fastened with the receiving portions;

a recessed portion is provided between two shoulder portions of the base; and the recessed portion accommodates a part of the annular body that extends rearward in such a manner that a surface of the annular body is not higher than a surface of the base.

18. The USB connector according to claim 11, wherein a recess is provided on the plate body of the second metal member; and an outer surface of a convex portion of the recess is covered by the plastic housing without being exposed to the outside.

19. The USB connector according to claim 11, wherein the second metal member comprises second welding portions formed by two lateral sides being bent and then extending; and the welding feet of the first metal member and the second welding portions are configured to be welded to a circuit board.

20. A USB connector, comprising:

a docking assembly;

a plastic housing provided with a receiving cavity; and a metal member integrated with and formed inside the plastic housing, wherein the docking assembly is inserted into the plastic housing; the docking assembly comprises an insulation body and a conductive terminal integrated with and formed inside the insulation body; the insulation body comprises a base and a docking tongue extending forward from the base; wherein the metal member comprises an annular body sleeved on the base, a first snap-in portion fixed to a front end of the base and arranged at a front end of the annular body, and a second snap-in portion fixed to a rear end of the base and arranged at a rear end of the annular body, the front end of the annular body being close to the docking tongue, and the rear end of the annular body being opposite to the front end of the annular body and being facing away from the docking tongue; the docking assembly is fixed by the annular body; and the second snap-in portion is bent to be fixed on a surface of a tail of the base; and wherein the docking tongue extends out of the annular body along a direction from the base to the docking tongue.

* * * * *